United States Patent [19]
Omichi et al.
[11] 4,308,344
[45] Dec. 29, 1981

[54] PROCESS FOR PRODUCTION OF A PHOTOGRAPHIC LIGHT-SENSITIVE MATERIAL

[75] Inventors: Takenori Omichi; Takeshi Konno; Sumitaka Tatsuta, all of Fujinomiya, Japan

[73] Assignee: Fuji Photo Film Co., Ltd., Minami-ashigara, Japan

[21] Appl. No.: 132,355

[22] Filed: Mar. 20, 1980

[30] Foreign Application Priority Data

Mar. 20, 1979 [JP] Japan ..... 54-33100

[51] Int. Cl.[3] ..... G03C 1/78

[52] U.S. Cl. ..... 430/523; 430/539; 430/930; 430/935; 430/531

[58] Field of Search ..... 430/523, 531, 539, 930, 430/935

[56] References Cited

U.S. PATENT DOCUMENTS 3,674,534 7/1972 Conniar ..... 430/935
4,048,357 9/1977 Van Paesschen et al. ..... 430/935

*Primary Examiner*—Jack P. Brammer
*Attorney, Agent, or Firm*—Sughrue, Mion, Zinn, Macpaek and Seas

[57] ABSTRACT

A process for producing a photographic light-sensitive material comprising providing a first light-sensitive photographic emulsion layer on one side of a support having a surface resistivity greater than $10^{14}\Omega$ and a thickness of not more than 230μ and providing a light-sensitive photographic emulsion layer or a gelatin-containing back layer on the opposite side of the support wherein between the time the first emulsion layer is coated and the time the opposite surface of the support is coated, (i) the opposite surface of the support is prevented from coming into contact with anything except rolls having a diameter larger than about 50 mm, and (ii) the water/gelatin weight ratio in the photographic emulsion layer(s) coated on the first surface of the support prior to coating the second surface is not less than 1. The process is particularly applicable to production of X-ray films.

8 Claims, 3 Drawing Figures

FIG 1
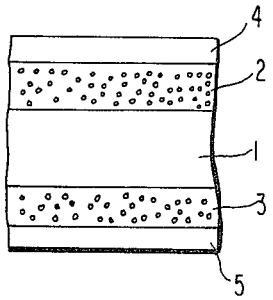
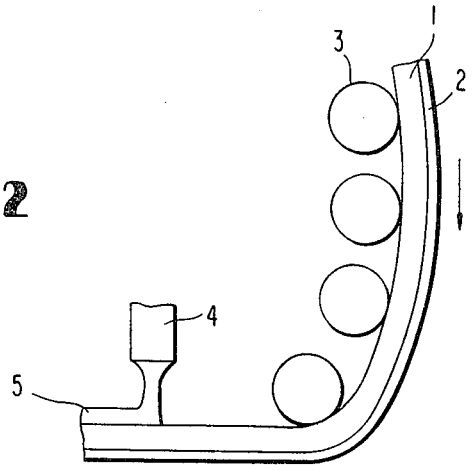
FIG 2
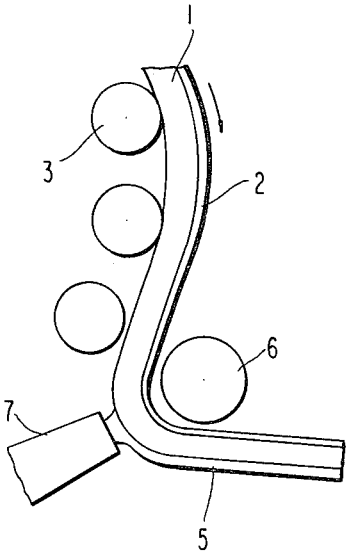
FIG 3

PROCESS FOR PRODUCTION OF A PHOTOGRAPHIC LIGHT-SENSITIVE MATERIAL

BACKGROUND OF THE INVENTION

1. Field of the Invention

This invention relates to a process for producing a photographic light-sensitive material. More particularly, it is concerned with a process for producing a photographic light-sensitive material which comprises providing a light-sensitive photographic emulsion layer and/or a gelatin back layer directly on both sides of a support having a surface resistivity of more than $10^{14}\Omega$ without incorporating any antistatic agent in the support, without providing any antistatic layer on the support, and without forming static marks.

2. Description of the Prior Art

Photographic light-sensitive materials (hereinafter referred to merely as light-sensitive materials) are generally produced by coating light-sensitive photographic emulsions (hereinafter referred to merely as photographic emulsions) containing various additives on a support and subjecting the support so coated to cooling and drying procedures.

In these light-sensitive materials, the coating of photographic emulsions is usually applied to both sides of the support. For example, a light-sensitive emulsion is coated on both sides of a support, or a light-sensitive emulsion is coated on one side of a support and on the other side a non-sensitive photographic layer is provided to prevent curling, halation and so on. In accordance with the procedure usually employed for production of these both sides-coated materials, a desired photographic emulsion layer is first provided on one side of a support, which is then cooled and dried; the resulting member is wound around a reel; and thereafter, while transporting the member, another photographic emulsion layer is provided on the opposite side of the support, which is then cooled and dried.

In this procedure, however, wherein the photographic emulsion layers are provided on both sides of the support by coating the photographic emulsions firstly on one side of the support and then on the other side, the support is inevitably delivered and conveyed with one surface thereof exposed. Therefore, when the support has a surface resistivity of greater than $10^{14}\Omega$, electrostatic discharge occurs when the exposed surface of the support comes in contact with a conveyor roll. This leads to fogging of the photographic emulsion layer provided on the reverse side and to the formation of static marks.

"Static marks" are those dot or branch-like marks which appear on a light-sensitive material on subjecting it to development processing. The formation of static marks is believed to be from the discharge of electric charges accumulated by contact, friction and so on of the light-sensitive materials with each other or with other materials, leading to fogging of the photographic emulsion layer.

Therefore, when the surface resistivity of the support is greater than $10^{14}\Omega$, it has been necessary to incorporate an antistatic agent in the support or to coat the antistatic agent on the support (a so-called subbing layer.)

Heretofore, a subbing layer has usually been provided on a support in order to firmly bond the hydrophobic plastic support and the hydrophilic photographic emulsion layer. However, incorporation of an antistatic agent into the subbing layer leads to a reduction in adhesive strength. Moreover, upon coating of the subbing layer, repelling frequently occurs, and after the coating, blocking among the supports takes place. Thus, it has been quite difficult to choose those subbing agents and antistatic agents which are free from the problems described above.

Recently, a procedure has been proposed in which a photographic emulsion layer is provided on a support only after surface treatment (for example, corona discharge treatment, flame treatment, ultraviolet ray treatment, high frequency wave treatment, glow discharge treatment, plasma treatment, ozone oxidation treatment, etc.) of the support without providing any subbing layer, in order to reduce the complexity of the subbing step and to decrease the production costs. However, the surface resistivity of the support subjected to the surface treatment is always more than $10^{14}\Omega$. Therefore, a coating step performed to lower the surface resistivity has been required, and it has not been possible to practically employ the no-subbing technology which has been devised for reducing production costs.

The antistatic treatment of the support surface, which is essential for preventing the formation of static marks during the production of the light-sensitive material, generally has little influence on the antistatic properties of the product light-sensitive material. That is to say, to render the light-sensitive material free from the formation of static marks upon subsequent handling, it is necessary to use an additional antistatic treatment on the outermost photographic layers. In this sense, the antistatic treatment of the support surface is quite uneconomical since it is useful only in production steps. Therefore, there has been desired a procedure which enables one to prevent the formation of static marks during the production of a light-sensitive material without applying any such antistatic treatment.

SUMMARY OF THE INVENTION

An object of this invention is to provide a process for producing a light-sensitive material, said process comprising providing a light-sensitive photographic emulsion layer directly on one side of a support having a surface resistivity of greater than $10^{14}\Omega$ and providing a light-sensitive photographic emulsion layer or gelatin back layer directly on the opposite side of the support without forming any static marks during the production of the light-sensitive material.

It has now been found that the above object is attained by preventing the uncoated side or exposed surface of the support from coming into contact with anything except air or rolls having a diameter larger than about 50 mm, and by making the water/gelatin weight ratio in the photographic emulsion layer(s) provided on the first surface of the support not less than 1. This procedure is used between the time the first photographic emulsion layer is coated and the opposite side of the support is coated and enables the support to be coated directly without prior incorporation of an antistatic agent in or on the support.

Therefore, this invention provides a process for producing a photographic light-sensitive material which comprises providing light-sensitive photographic emulsion layer(s) on a first surface of a support having a surface resistivity of greater than $10^{14}\Omega$ and a thickness of less than $230\mu$ and providing a light-sensitive photographic emulsion layer or a gelatin back layer on a second surface of the support, wherein during the period between coating the first surface of the support to coating the second surface, the second surface is prevented from coming into contact with anything except rolls having a diameter larger than 50 mm, and wherein the water/gelatin weight ratio in the layer(s) coated on the first surface of the support prior to coating the second surface is not less than 1.

BRIEF DESCRIPTION OF THE DRAWINGS

FIG. 1 is a cross-sectional view of a photographic light-sensitive material produced by the process of this invention;

FIG. 2 is a side view of a coating apparatus used in the practice of this invention; and FIG. 3 is a side view of another coating apparatus used in the practice of this invention.

DETAILED DESCRIPTION OF THE INVENTION

As supports having a surface resistivity of greater than $10^{14}\Omega$ used in the practice of this invention, those films made of cellulose esters (particularly, cellulose triacetate, cellulose diacetate, cellulose propionate), polyamides (particularly nylon), polycarbonates, polyesters (particularly polyethylene terephthalate, poly-1,4-cyclohexanedimethylene terephthalate, polyethylene-1,2-diphenoxyethane 4,4'-dicarboxylate), polystyrene, polyethylene, polypropylene and the like, and composite films prepared by coating or laminating these films one upon another or on other materials, such as paper, can be used. In addition, those supports prepared by coating certain materials on the above supports and having a surface resistivity of greater than $10^{14}\Omega$ can be effectively used in the practice of this invention.

These supports are preferably surface-activated by a surface treatment such as corona discharge treatment, vaccum glow discharge treatment, flame treatment, ultraviolet ray treatment, high frequency treatment, plasma treatment, ozone oxidation treatment and so on.

One of the features of this invention is that it is possible to provide a photographic emulsion layer directly on a support having a surface resistivity greater than $10^{14}\Omega$ without forming any static marks.

The thickness of the support is not more than about $230\mu$ and preferably about 50 to $230\mu$. When the thickness of the support is more than $230\mu$, it is not possible to prevent the formation of static marks even though the water/gelatin weight ratio in the photographic emulsion layer (first layer) is not less than 1.

A typical embodiment of light-sensitive materials produced by the process of this invention is illustrated in FIG. 1. This light-sensitive material comprises a support (1), a photographic emulsion layer (2) provided on one side of the support (1), a photographic emulsion layer (3) provided on the opposite side of the support (1), and surface protective layers (4) and (5) provided on the photographic emulsion layers (2) and (3), respectively. Another photographic layer (for example, another photographic emulsion layer) may be placed between the photographic emulsion layer and the surface protective layer. A gelatin back layer may be used in place of the photographic emulsion layer (3).

This invention will be hereinafter explained in detail by reference to the light-sensitive material illustrated in FIG. 1. The photographic emulsion layers (2) and (3) are, respectively, the first photographic emulsion layer and the second photographic emulsion layer, and the side on which the first photographic emulsion layer is provided and the surfaces on which the second photographic emulsion layer is provided are respectively, the first surface and the second surface.

In accordance with the process of this invention the first photographic emulsion layer is first provided on the first surface of the support having a surface resistivity of greater than $10^{14}\Omega$. Other photographic layers, such as the surface protective layer and the like may be provided simultaneously with the first photographic emulsion layer, as necessary.

The coating procedure with which the first photographic emulsion layer is provided on the first surface is not critical and those procedures well known in the art can be employed. For example, dip coating, doctor blade coating, gravure coating, air knife coating, bead coating, extrusion coating, hopper coating, curtain coating and the like can be employed. These coating procedures can be employed by reference to the descriptions in U.S. Pat. Nos. 3,632,374, 2,941,898, 3,425,857, 3,645,773, 4,001,024, 2,761,418, 3,474,758, 3,749,053, 3,958,532, 3,996,885, etc.

This invention is characterized in that during the period from coating the first light-sensitive photographic emulsion layer and, as necessary, other light-sensitive photographic layers on the first surface of the support to the coating of the second photographic emulsion layer on the second surface of the support, the following requirements are essential:

I. The second surface of the support is prevented from coming into contact with anything except rolls having a diameter larger than 50 mm; and II. The water/gelatin weight ratio in the photographic emulsion layer(s) coated on the first surface of the support prior to coating the second surface is not less than 1.

In order to comply with the above requirement I, the support is conveyed in contact with rolls having a diameter of more than 50 mm, or the support is conveyed on a cushion of air without being brought into contact with any rolls. Contact with larger rolls is believed not to result in static marks because the film moves away from the roll at a slower speed than it would move away from a smaller diameter roll during conveying.

The procedure of conveying the support by air floating can be employed by reference to the description in U.S. Pat. Nos. 3,060,594, 3,481,046, 3,553,848, 3,557,870, 3,599,341, Japanese Patent Publication Nos. 30232/71, 20438/68, 2451/75, 3427/76, 8226/76, 48148/77, etc.

In order to comply with the above requirement II, the photographic emulsion layer coated on the first surface of the support is, after being coated on the first surface, solidified by cooling, and the support is conveyed in such a manner that this photographic layer is dried little or is not dried at all until a photographic emulsion layer is provided on the second surface of the support. The water/gelatin weight ratio in the photographic emulsion layer provided on the first surface of the support and any other emulsion layers provided on the first surface prior to coating the second surface preferably ranges from about 1 to 20, more preferably from about 1 to 16. Thus, when a plurality of photographic layers, such as a surface protective layer and the like, are provided simultaneously with the first photographic emulsion layer, the water/gelatin weight ratio in all of the layers simultaneously provided is maintained at not less than 1.

Solidification conditions of the first photographic emulsion layer(s), drying conditions and so on vary depending upon the composition and the like of the emulsion used. These conditions, however, can be readily determined by one skilled in the art.

Hereinafter, coating, drying and conveying methods employed in the practice of this invention will be explained in detail by reference to FIGS. 2 and 3.

In the embodiment illustrated in FIG. 2, a first photographic emulsion layer (2) is provided on the first surface of a support (1) and the so provided first photographic emulsion layer (2) is solidified by cooling while conveying the support (1) with the second surface thereof in contact with a plurality of metal rolls (3) having a diameter of more than 50 mm and arranged in an arc form. Then, while controlling the water/gelatin weight ratio in the photographic emulsion layer so that it is not less than 1, a photographic emulsion layer (5) is provided on the support (1) by use of a curtain coating equipment (4), which is then cooled, solidified, dried and wound around a reel. Thus, a light-sensitive material free from any static marks can be obtained.

In another embodiment illustrated in FIG. 3, a photographic emulsion layer is provided on the second surface of support (1) using extrusion coating equipment (7) while floating the support (1) by use of an air floating type of reverse roll (6).

Alternatively, there can be considered a procedure in which the support is completely prevented from coming into contact with anything during the period from the coating of the first surface photographic emulsion layer to coating the second surface. This procedure, however, suffers from the disadvantage that stable conveyance of the support and stable coating of the photographic emulsion layer are difficult. For this reason, it is preferred that those rolls for stably conveying the support are placed between the coating of the first photographic emulsion layer and that of the second photographic emulsion layer.

In the process of this invention, it is essential that the diameters of the pass rolls in contact with the support during the period from the coating of the first photographic emulsion layer to coating the second surface are more than 50 mm and that the water/gelatin weight ratio in the first photographic emulsion layer(s) is maintained at not less than 1 until the coating of the second photographic emulsion layer on the second surface of the support is completed. For coating, drying and so on, however, those techniques well known in the art can be employed.

After the photographic emulsion layers have been provided on both sides of the support, special antistatic procedures as those used in the present invention are not necessary if the outermost layer of the light-sensitive material is rendered antistatic. That is the present invention has for its object preventing static marks which result in the layer coated on the first surface of the support while the film is transferred with the second surface of the support uncoated. After an emulsion layer is coated on both surfaces of the film, the static marks can be prevented using well known techniques such as incorporating antistatic agents in the emulsion layer.

In the process of this invention, the time from the coating of the first layer on the first surface of the support to that of the second layer on the reverse side, and the distance between the location where the first surface is coated and the location where the second surface is coated, can be appropriately varied so long as the water/gelatin weight ratio is not less than 1. Therefore, any suitable procedures can be employed in coating the photographic emulsion layer in the practice of this invention. Furthermore, it is possible to coat different solutions on both sides of the support.

In the prior art methods in which the formation of static marks during the production of light-sensitive materials is prevented by incorporating in advance an antistatic agent into an subbing layer, the antistatic effect is greatly influenced by the humidity of the atmosphere, and in many cases, it has not been possible to greatly reduce the humidity of the atmosphere during the drying step. On the other hand, the antistatic effect of this invention is not influenced at all by the humidity of the atmosphere. Therefore, it is possible to effect drying in the atmosphere of quite low humidities. This helps speed-up of the drying step.

Hereinafter, the composition of the photographic emulsion layer of this invention will be explained.

The composition, layer-construction and so on of the photographic emulsion layers are not critical, and those compositions, layer-constructions and techniques well known in the art can all be used in this invention. Especially preferred photographic emulsion layers are light-sensitive silver halide emulsion layers. Light-sensitive silver halides as herein usable include silver bromide, silver iodobromide, silver chloroiodobromide, silver chloride, silver chlorobromide and the like. A preferred light-sensitive silver halide is silver iodobromide (silver iodide of less than 10 mol %).

As a binder for use in the photographic emulsion layer, gelatin is essential. The gelatin can be used in combination with natural or synthetic hydrophilic colloids, polymer latexes, or the like.

The photographic emulsion layer can further contain a gelatin hardening agent, a surface active agent, a chemical sensitizing agent for silver halide, a stabilizer, an antifogging agent, a sensitizing dye, a dye and the like.

Preferred gelatin hardening agents include aldehydes such as glutaraldehyde, active vinyl compounds such as bis(vinylsulfonyl)methyl ether, active halogen compounds such as 2,4-dichloro-6-hydroxy-S-triazine, mucohalogenic acid such as mucochloric acid, chromium alum and the like.

Preferred surface active agents include saponin, alkyleneoxide derivatives, aliphatic acid esters of polyvalent alcohols, alkylcarboxylic acid salts, alkylsulfonic acid salts, alkylbenzenesulfonic acid salts, aminoalkylsulfonic acids, alkylbetaines, aliphatic or aromatic quaternary ammonium salts, and the like.

The kinds of additives used in the photographic emulsion layer and the method of adding these additives can be determined referring to the description in *Research Disclosure*, Vol. 176, pp. 22 to 31 (Dec., 1978).

In this invention, other photographic layers, such as a surface protective layer, can be provided on the photographic emulsion layer, as necessary. As a binder for use in the surface protective layer, gelatin is preferably used. In addition, various additives such as a matting agent, a slipping agent, a gelatin hardening agent, a surface active agent, an antistatic agent and the like can be added. As matting agents, those particles comprising silicon dioxide, polymethyl methacrylate and the like, and having a diameter of 0.5 to 5 microns are preferably used.

Although the above explanation was made by reference to the case where the second layer is a photographic emulsion layer, the second layer may be a gelatin back layer. The gelatin back layer is a layer for use in curl balance, anti-halation and the like, in which gelatin is used as a binder.

The gelatin back layer can contain, in addition to the gelatin, a dye, a surface active agent, a gelatin hardening agent, a matting agent, a hydrophilic polymer except for gelatin, a slipping agent and the like.

These additives can be determined by reference to the description in *Research Disclosure*, Vol. 176, page 27 (Dec., 1978). Furthermore, coating methods, drying methods and so on can be determined referring to the description in *Research Disclosure*, Vol. 176, page 27 (Dec., 1978).

The following examples are given to illustrate embodiments of this invention although this invention is not limited by them.

EXAMPLE 1

A polyethylene terephthalate film (thickness 180μ) having a surface resistivity of greater than $10^{16}\Omega$ (25° C., 65% RH) was used as a support, and both sides were subjected to corona discharge treatment. The conditions of the corona discharge treatment were the same as those employed in Example 3 of U.S. Pat. No. 3,874,877.

No change in surface resistivity before and after the corona discharge treatment was observed. On a first surface of this support was coated a first photographic emulsion for roentgen (X-ray) by use of a bead-coater as described in U.S. Pat. No. 3,429,741. The support was conveyed while keeping the second surface of the support in contact with 20 chromium-plated metal rolls 75 mm in diameter arranged in the arc form as illustrated in FIG. 2, and the emulsion was solidified on cooling at 4° C. 20 seconds after the coating of the first layer, a second X-ray photographic emulsion layer was provided on the second surface of the support by use of a curtain coating equipment as described in U.S. Pat. No. 3,508,947.

At the time of coating the second layer, the water/gelatin weight ratio in the first layer was 12.0. After being cooled and solidified, the second layer was dried under the conditions of 30° C. and 60% RH for 10 minutes. On subjecting the above obtained roentgen light-sensitive material to a typical developing treatment, no static marks were found.

For comparison, the same procedure as above was repeated except that the support was conveyed in contact with the metal rolls after the first layer was dried prior to the coating of the second layer on the reverse side and the water/gelatin weight ratio in the first layer was adjusted to 0.5 at the time of coating the second layer. On developing the above obtained light sensitive material, static marks were found in many places.

However, when the water/gelatin weight ratio in the first layer was 1.0 at the time of coating the second layer even though the first layer was dried prior to the coating of the second layer and the support was conveyed in contact with the metal rolls, no static marks were found.

EXAMPLE 2

An 80μ thick polyethylene film having a surface resistivity of $10^{16}\Omega$ (25° C., 65% RH) was used as a support and both sides were subjected to a flame treatment as in Example 5 of the specification of U.S. Pat. No. 3,874,877. No change in surface resistivity before and after the flame treatment was observed.

On a first surface of the support was coated an X-ray photographic emulsion by dipping. Then, the support was conveyed while keeping the second surface of the support in contact with 10 stainless steel rolls 100 mm in diameter arranged in arc form as illustrated in FIG. 3, and the coated emulsion layer was cooled and solidified.

On the second surface of the support was coated a second X-ray photographic emulsion by use of an extrusion coating equipment while floating the support by use of air floating type reverse rolls described in U.S. Pat. No. 3,496,005. At the time of coating the second layer, the water/gelatin weight ratio in the first layer was 14.0. Thereafter, the above material was set, dried and wound in a typical manner, whereby the product light-sensitive material was obtained. On developing this light-sensitive material, no static marks were observed.

For comparison, the same procedure as above was repeated except for that 20 metal rolls 30 mm diameter were used in place of 10 stainless steel rolls 100 mm in diameter. On developing the obtained light-sensitive material, static marks were found here and there.

While the invention has been described in detail and with reference to specific embodiments thereof, it will be apparent to one skilled in the art that various changes and modifications can be made therein without departing from the spirit and scope thereof.

What is claimed is:

1. In a process for producing a photographic light-sensitive material comprising providing a light-sensitive photographic emulsion layer directly on a first surface of a support having a surface resistivity greater than $10^{14}\Omega$ and a thickness not more than 230μ, and providing a second light-sensitive photographic emulsion layer or gelatin back layer directly on the second surface of the support, the improvement which comprises achieving sufficient adhesion between said layers and said support and preventing static marks by a method which comprises during the period from the coating of the first surface of the support to coating the second surface, (i) the second surface is prevented from coming into contact with anything except air or rolls having a diameter larger than about 50 mm, and (ii) the water/gelatin weight ratio in the layer(s) coated on the first surface of the support is not less than 1.

2. The process of claim 1, wherein the second surface is conveyed in contact with rolls having a diameter larger than about 50 mm.

3. The process of claim 1, wherein the second surface is floated on cushion of air.

4. The process of claim 1, wherein the water/gelatin weight ratio of the first layer is not less than 1 by conveying the support in such a manner that the first layer is dried little or is not dried at all until the second surface of the support is coated.

5. The process of claim 1, wherein the water/gelatin weight ratio in the first layer is from 1 to 20.

6. The process of claim 1, wherein the thickness of the support is about 50 to 230μ.

7. The process of claim 1, wherein said light-sensitive material is an X-ray film.

8. The process of claim 1, wherein at least one surface of the support is subjected to a treatment which improves adhesion between the surface and the adjacent layer.

* * * * *